US011208176B1

(12) United States Patent
Ray et al.

(10) Patent No.: US 11,208,176 B1
(45) Date of Patent: Dec. 28, 2021

(54) TETHERED FLOATING DEVICE

(71) Applicants: David Ray, Mt. Juliet, TN (US); Michael E. Haarlander, Nashville, TN (US)

(72) Inventors: David Ray, Mt. Juliet, TN (US); Michael E. Haarlander, Nashville, TN (US)

( * ) Notice: Subject to any disclaimer, the term of this patent is extended or adjusted under 35 U.S.C. 154(b) by 0 days.

(21) Appl. No.: 16/553,898

(22) Filed: Aug. 28, 2019

Related U.S. Application Data

(60) Provisional application No. 62/723,538, filed on Aug. 28, 2018.

(51) Int. Cl.
*B63B 34/00* (2020.01)
*B63B 21/24* (2006.01)
*B63C 9/26* (2006.01)

(52) U.S. Cl.
CPC ..... *B63B 34/00* (2020.02); *B63B 21/24* (2013.01); *B63C 9/26* (2013.01)

(58) Field of Classification Search
CPC ..... B63B 34/00; B63B 34/40; B63B 34/45; B63B 34/50; B63B 21/24; B63C 9/00; B63C 9/26; B63C 9/28; B63C 9/30
USPC .. 441/65, 67, 75, 80, 84, 88, 125, 129, 131, 441/133, 136
See application file for complete search history.

(56) References Cited

U.S. PATENT DOCUMENTS

| | | | | | |
|---|---|---|---|---|---|
| 3,422,778 | A * | 1/1969 | Halfon | B63B 32/00 | 114/355 |
| 4,567,961 | A * | 2/1986 | Schoenfeld | B63C 9/26 | 182/3 |
| 4,928,618 | A * | 5/1990 | Kubli | B63B 21/22 | 114/293 |
| 5,902,164 | A * | 5/1999 | Shoemaker | B63B 32/70 | 441/75 |
| 6,394,867 | B1 * | 5/2002 | Bianco | B63C 9/04 | 114/360 |
| 7,389,750 | B1 * | 6/2008 | Rogers | A01K 27/005 | 119/792 |
| 8,776,732 | B2 * | 7/2014 | Bredesen | A01K 87/007 | 119/770 |
| 9,017,125 | B2 * | 4/2015 | Ventura | B63B 32/50 | 441/75 |
| 9,021,973 | B2 * | 5/2015 | Smith | B63B 43/02 | 114/123 |
| 9,102,386 | B2 * | 8/2015 | Roach | B63B 45/00 | |
| 10,200,522 | B2 * | 2/2019 | Berggren | B63B 49/00 | |
| 2011/0256518 | A1 * | 10/2011 | Rott | B63B 32/10 | 434/247 |
| 2015/0197323 | A1 * | 7/2015 | Cerdas | B63C 9/04 | 441/40 |

* cited by examiner

*Primary Examiner* — Daniel V Venne
(74) *Attorney, Agent, or Firm* — Wayne Edward Ramage; Baker Donelson

(57) ABSTRACT

A central floating device with a plurality of peripheral connection points and tethers. The tethers may be retractable, and are of sufficient length to allow the users some amount of spacing distance from each other. Each individual user thus maintains a separation from each other so as not to interfere with each other in the pool, lake, or body of water while remaining tethered together. The floating device may further include cup-holders, lights, storage compartments, and an anchor.

16 Claims, 10 Drawing Sheets

TETHERED FLOATING DEVICE

This application claims benefit of and priority to U.S. Patent App. No. 62/723,538, filed Aug. 28, 2019, which is incorporated herein in its entirety by specific reference for all purposes.

FIELD OF INVENTION

This invention relates to an apparatus providing a centralized tethered floating device that anchors one or more users to a central float.

SUMMARY OF INVENTION

In various exemplary embodiments, the present invention comprises a central floating device with a plurality of tether connection points and/or tethers. The tethers may be retractable, and are of sufficient length to allow the users some amount of spacing distance from each other. In one exemplary embodiment, there are 6 to 8 connection points. Each individual user thus maintains a separation from each other so as not to interfere with each other in the pool, lake, or body of water while remaining tethered together.

The central floating device can be of any suitable size and shape, including, but not limited to, a circle, oval, square, rectangle, hexagon octagon, or any other geometric shape. Tether connections points may be located at points along the top, bottom, or outer edge of the central floating device. Some connection points may allow only a single tether to be connected, while other forms of connection points may allow multiple tethers. Some areas may allow expansion or reduction of connection points. The connection point may be a loop or bar, curved or straight, to which a snap-lock hook, latch, hook-and-loop fasteners, or similar device at the end of a tether can be clipped or otherwise attached. Alternatively, these may be reversed, so that the connection point is a snap-lock hook or latch to which a loop or fastener at the end of the tether can be attached.

In one exemplary embodiment, the connection comprises a quick-release magnet unit, with a magnet at the connection point and a magnet affixed to the end of the tether. This allows for quick, safe connections, with a strength of connection sufficient to maintain connection in calm waters or in water with little or no current or wave activity. However, a user can quickly pull away and detach himself or herself by strongly swimming or pushing away from the central floating device. This allows some or all of a group of user to detach when necessary, such as when the group is heading for an obstacle that might be harmful to the party, or if rapids or water current in a river is too fast and requires individuals to maneuver on their own for safety.

An alarm system may be used to provide an audible and/or visual alarm when a magnetic coupler has been detached.

The user attaches himself or herself to the end of the tether opposite the connection element. In one embodiment, the user end of the tether comprises an ankle strap, which may comprise a hook-and-loop fastener or a metal catch with a steel strike. The strap may be brightly colored, padded, and comprise floatable material Alternatively, the ankle strap may comprise a magnetic fastener, which, as described above, allows the user to quickly detach himself or herself from the strap.

In one exemplary embodiment, the tethers are attached to a retractable reel on the central floating device, which allows the user to control his or her distance from the floating device. A user can maneuver freely while staying connected to the central floating device, and as discussed above, can quickly detach himself or herself in the event of an emergency or whenever desired.

In additional exemplary embodiments, the central floating device further comprises a plurality of cup or can holding indentations on the top or around the outside edge. Similarly, indentations can be provided to hold a cooler or food items. In one embodiment, a cooler is built into the central floating device. Storage compartments, which may or may not be water-tight, may also be provided in the central floating device for keys, lotions, money, first-aid kit, or other similar items. One or more umbrella or flag holders may be provided, so that the umbrellas may be inserted to provide shade for users, or one or more diver's flags can be inserted to provide notice that divers are in the area. A GPS device may be located in the floating device. LED or other forms of lights may be provided, including emergency or flashing lights.

In additional embodiments, holders for an MP3 player or music-playing device may be provided in or on the central floating device. An MP3 player or music-playing device also may be built-into the floating device. Similarly, a Bluetooth communications device could be securely installed in the central floating device in a protected space with one or more water-resistant or water-proof speakers, so that a Bluetooth device (e.g., smartphone) on a beach or a lounge chair by a pool could be paired therewith, allowing music or other electronic transmission from the central floating device while the smartphone or other Bluetooth device can avoid water damage.

In some exemplary embodiments, extra-long tethers may be provided to allow the central floating device to be secured to a point on or near the water, such as a pool ladder or a tree, thereby keeping the central floating device in a particular area.

Similarly, in several exemplary embodiments, one or more anchors attached by lines may descend from the central floating device, thereby also keeping the central floating device in a particular area. The anchor line could be attached to a motor or hand-crank for lowering and raising, or have a wound spring with a ratchet, so that the spring winds as the anchor is lowered, and the spring pulls the anchor quickly to the surface when released. In the event the group desired to travel further into a body of water, the anchor or anchor would be raised, the central floating device floated or drifted to a new location, and then released again to maintain the new location.

The anchor may be interchangeable, so that different configurations, shapes, sizes, and weights of anchors could be used for different bodies of water with different types of bottoms (e.g., flat cement pool bottom, rocky/sandy lake bottom, and so on). The anchor (and line) could be completely removed from the central floating device, allowing free movement thereof.

DETAILED DESCRIPTION OF EXEMPLARY EMBODIMENTS

Safety is a paramount concern for both children and adults when enjoying recreational activities in the water, such as a pool, river, pond, or lake. Various floating devices, such as rafts, tubes, inflatables, floating lounge chairs, and the like, are commonly used. However, even when such floating devices initially start in adjacent positions, movement, whether due to water currents, wind action, filtration equipment, or other causes, often carries the different devices, and their users, in different directions. In addition to separating groups of people who want to stay adjacent to each other, this movement also may cause safety issues.

Figure 1:
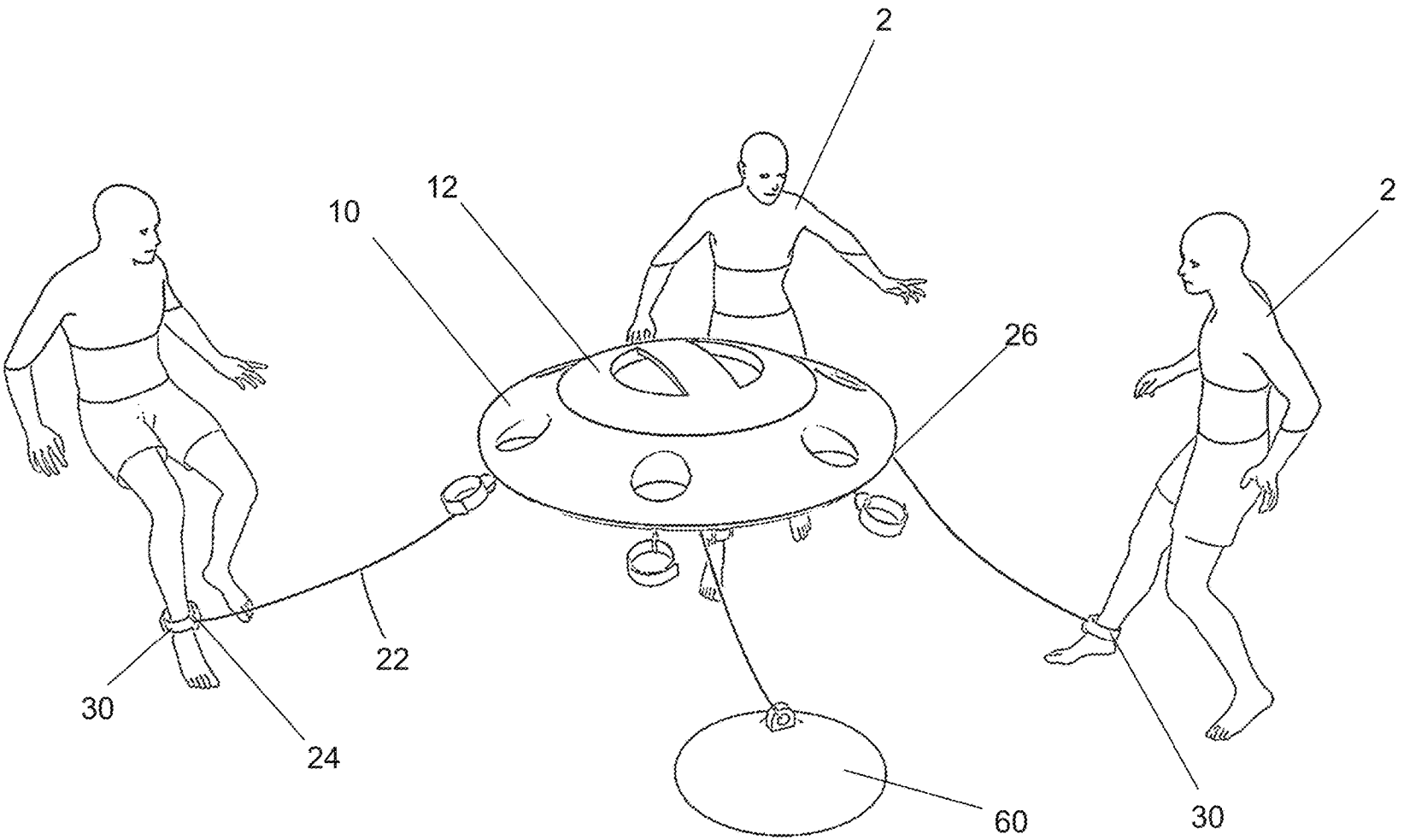
FIG. 1 shows a top perspective view of a device in use with an anchor in accordance with an exemplary embodiment of the present invention.
Figure 2A:
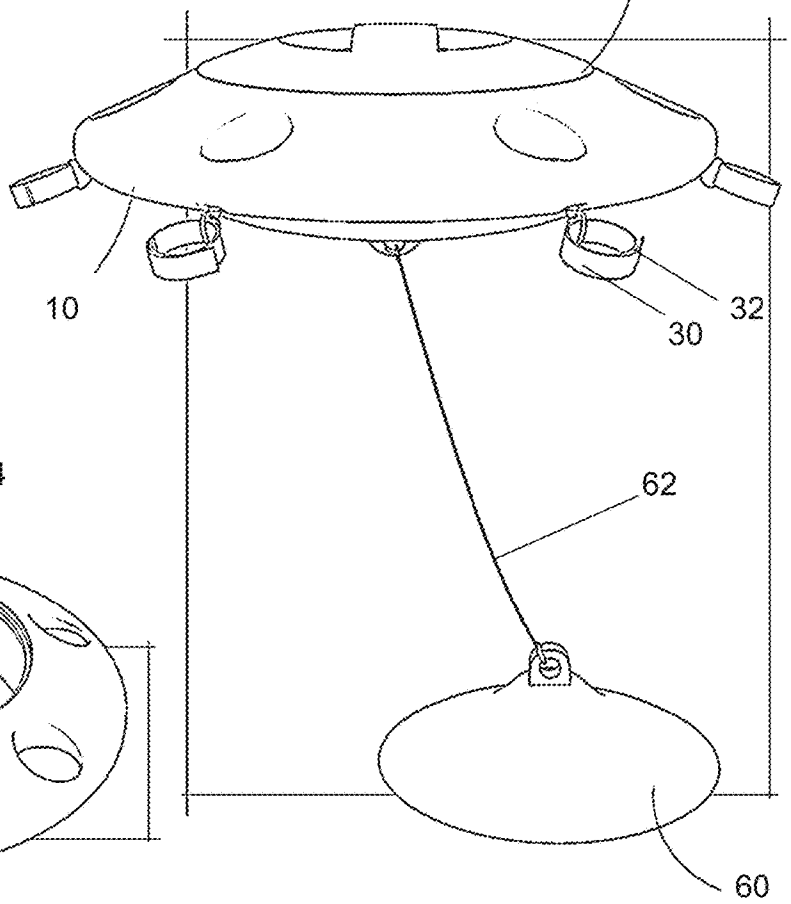
FIG. 2A shows a side perspective view of the central float with anchor of FIG. 1.
Figure 2B:
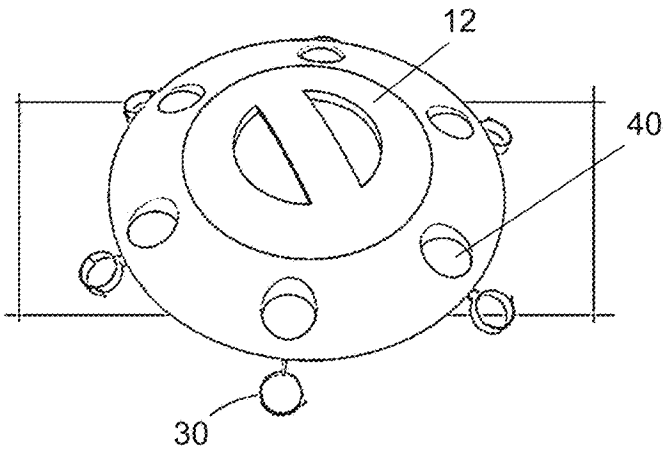
FIG. 2B shows a perspective view of the central float of FIG. 1.
Figure 2C:
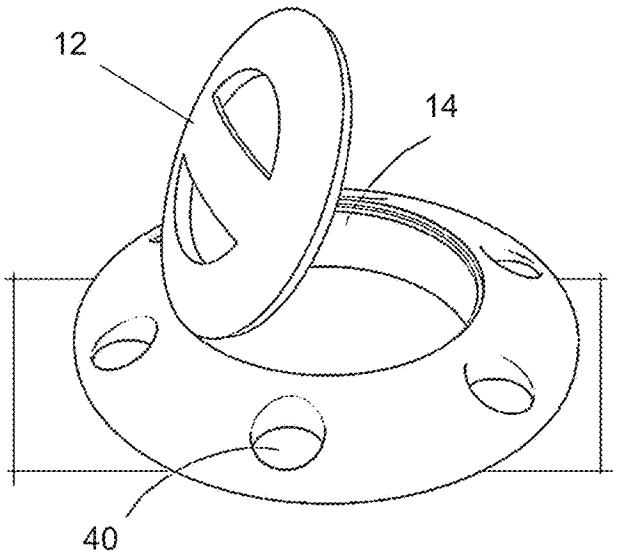
FIG. 2C shows a view of the float of FIG. 2B with lid opened.
Figure 3:
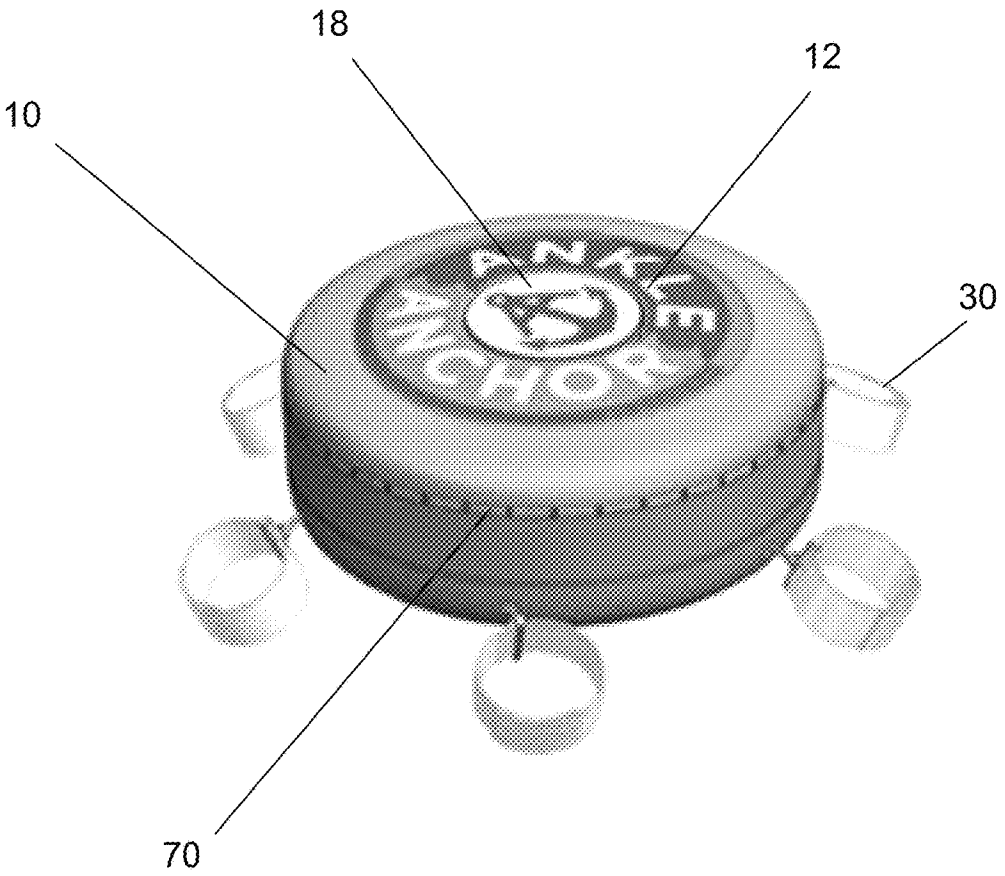
FIG. 3 shows an alternative top perspective view of a central float.

In various exemplary embodiments, the present invention comprises a central floating device or float 10 with a plurality of connectors 20. As seen in FIG. 1, each connector may comprise a tether or cord 22 with a remote attachment point 24 and a float attachment or connection point 26. The tether or cord 22 may be retractable, and is of sufficient length to allow users 2 (e.g., swimmers) some amount of spacing distance from each other.

In one exemplary embodiment, there are 6 to 8 connection points. Each individual user 2 thus maintains a separation from each other so as not to interfere with each other in the pool, lake, or body of water in which the float 10 is placed while remaining tethered together.

The central floating device 10 can be of any suitable size and shape, including, but not limited to, a circle, oval, square, rectangle, hexagon octagon, or any other geometric shape. Float connection points may be located at points along the top, bottom, or outer edge of the central floating device. Some connection points may allow only a single tether to be connected, while other forms of connection points may allow multiple tethers. Some areas may allow expansion or reduction of connection points. The connection point may be a loop or bar, curved or straight, to which a snap-lock hook, latch, hook-and-loop fasteners 32, or similar device at the end of a tether can be clipped or otherwise attached. Alternatively, these may be reversed, so that the connection point is a snap-lock hook or latch to which a loop or fastener at the end of the tether can be attached.

Figure 7:
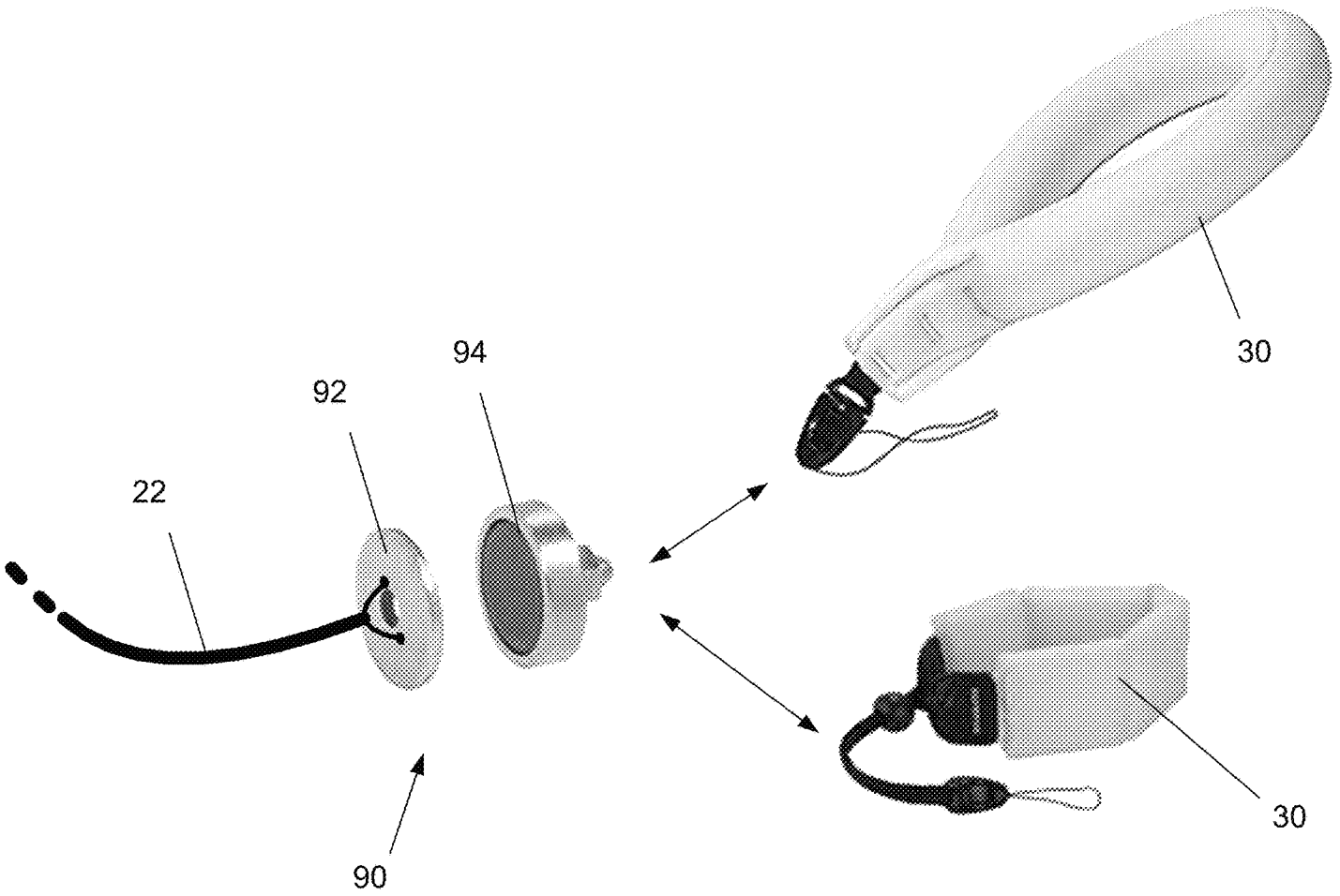
FIG. 7 shows examples of ankle straps.

In one exemplary embodiment, the float connection mechanism comprises a quick-release magnet unit 90, with a magnet 92 at the connection point and a magnet 94 affixed to the remote end of the tether cord 22 for connection to a strap 30, as seen in FIG. 7. This allows for quick, safe connections, with a strength of connection sufficient to maintain connection in calm waters or in water with little or no current or wave activity. However, a user 2 can quickly pull away and detach himself or herself by strongly swimming or pushing away from the central floating device 10, thereby breaking the magnetic connection. This allows some or all of a group of user to detach when necessary, such as when the group is heading for an obstacle that might be harmful to the party, or if rapids or water current in a river is too fast and requires individuals to maneuver on their own for safety. An alarm system may be used to provide an audible and/or visual alarm when a magnetic coupler has been detached.

The user 2 attaches himself or herself to the end 24 of the tether opposite the float connection point 26. In one embodiment, the user end of the tether comprises an ankle strap 30, which may comprise a hook-and-loop fastener or a metal catch with a steel strike. The strap may be brightly colored, padded, and comprise floatable material Alternatively, the ankle strap may comprise a magnetic fastener, which, as described above, allows the user to quickly detach himself or herself from the strap.

In one exemplary embodiment, the tethers 22 are attached to a retractable reel 34 on the central floating device 10, which allows the user 2 to control his or her distance from the floating device. A user can maneuver freely while staying connected to the central floating device, and as discussed above, can quickly detach himself or herself in the event of an emergency or whenever desired.

In additional exemplary embodiments, the central floating device 10 further comprises a plurality of cup or can holding indentations 40 on the top or around the outside edge. Similarly, indentations 42, 44 can be provided to hold a cooler or food items.

In further embodiments, the central float 10 comprises one or more storage areas 14 which may be covered by corresponding lids 12. One or more of the storage areas may comprise a built-in cooler. The lids may be watertight when closed. The storage compartments 14, which may or may not be water-tight, may be used to hold keys, lotions, money, first-aid kit, or other similar items.

Figure 5:
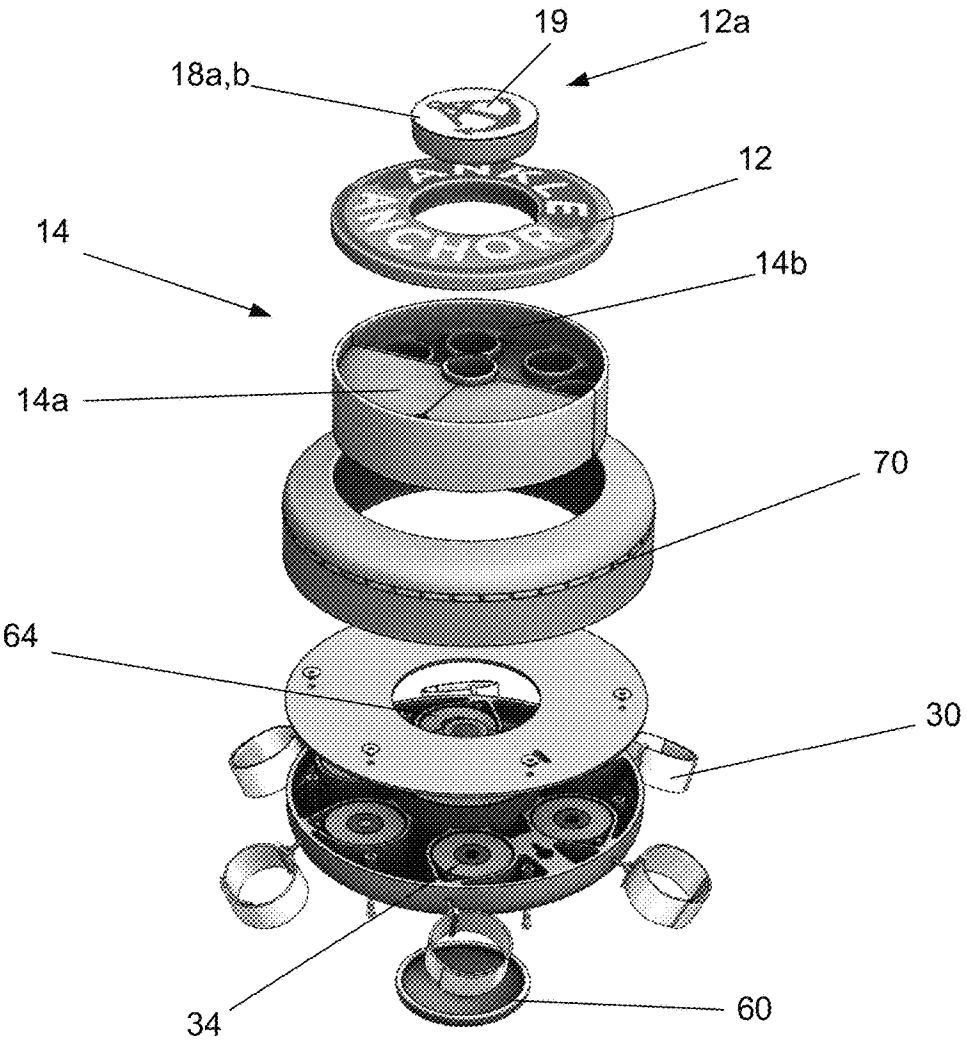
FIG. 5 shows an exploded view of a central float.
Figure 9:
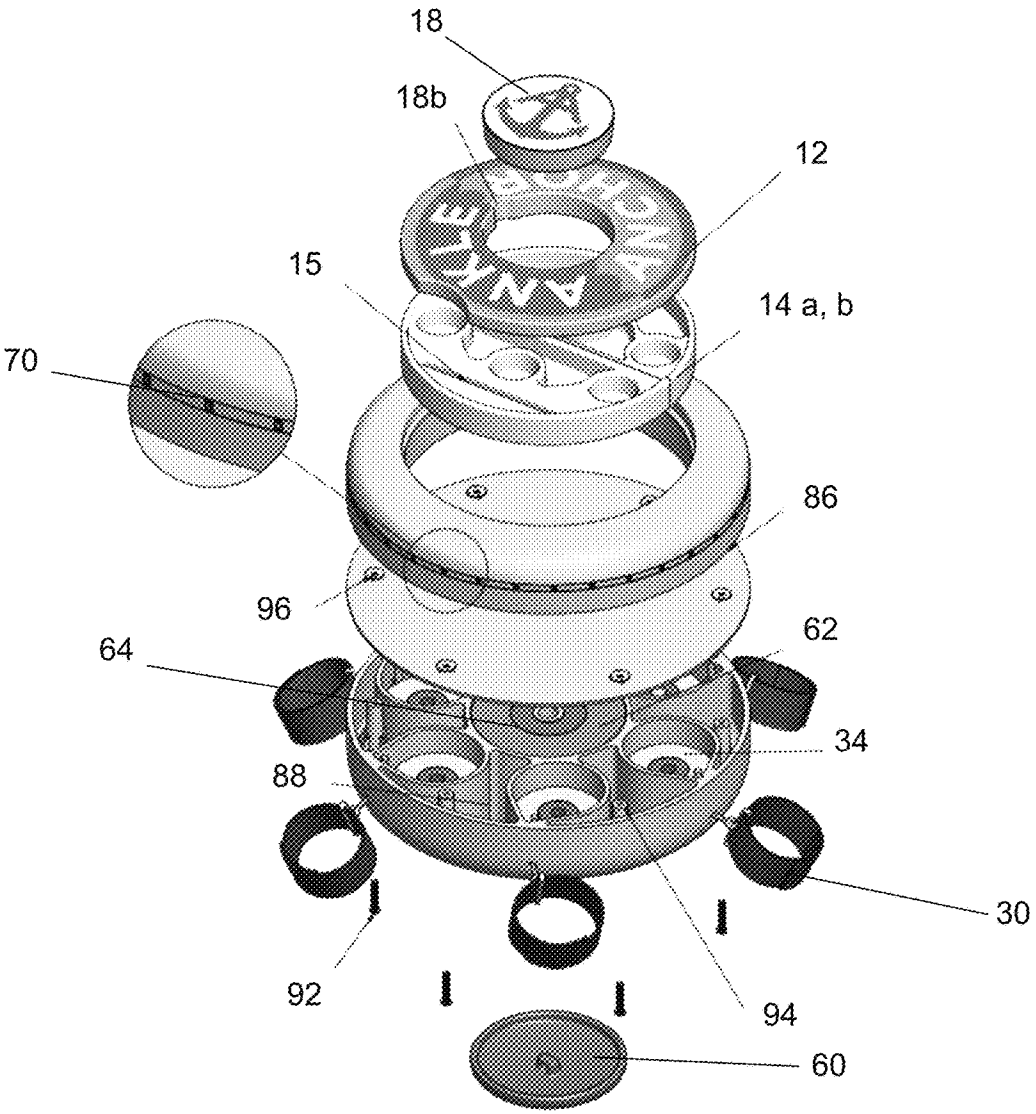
FIG. 9 shows an exploded view of another embodiment of the central float.
Figure 10:
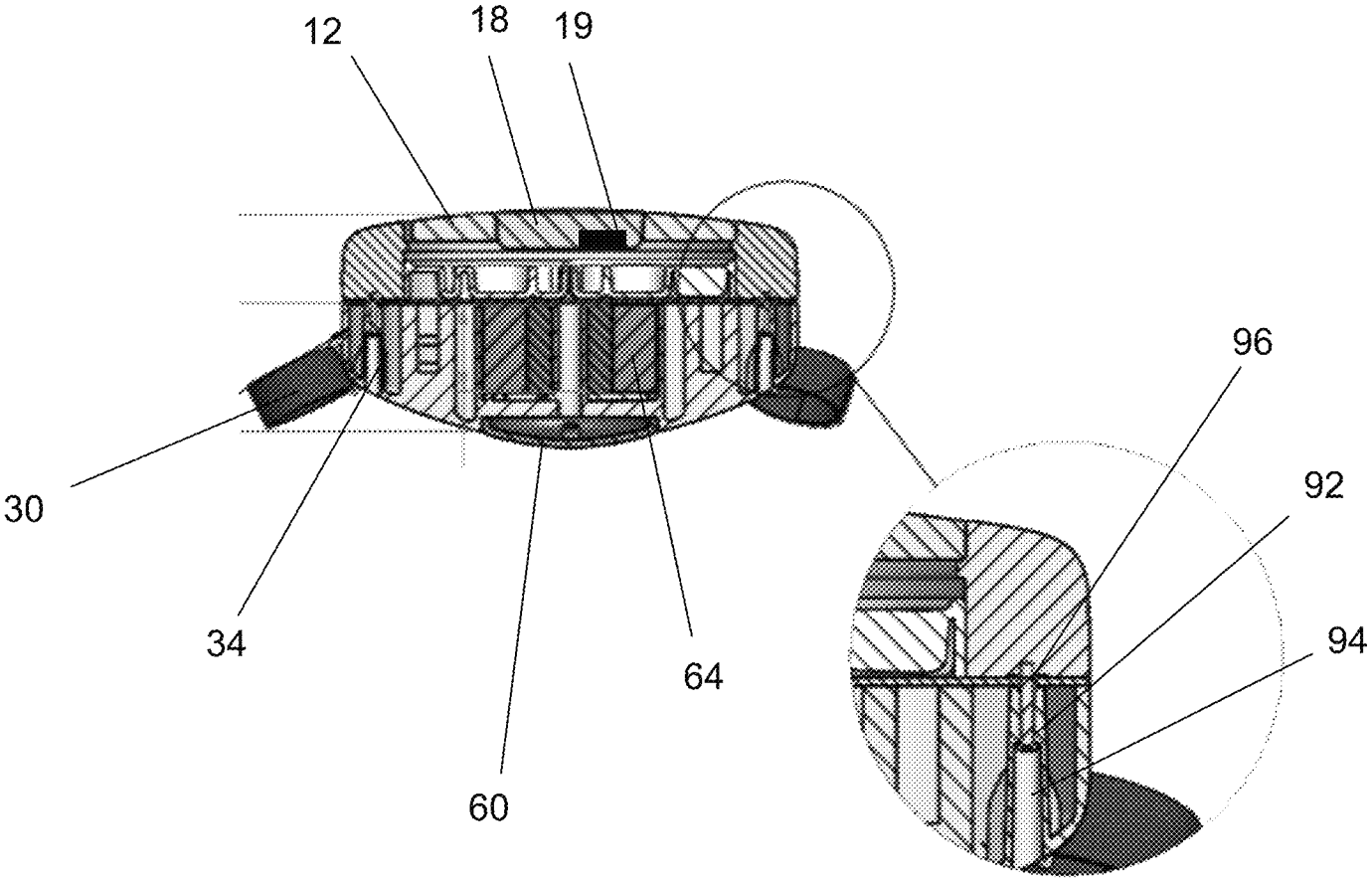
FIG. 10 shows a cross-sectional view of the central float of FIG. 9.

As seen in FIG. 5, the storage area may comprise both watertight 14*a* and non-watertight areas 14*b*. In this particular embodiments, two compartment with watertight lids are provided to store wallets, money, electronic devices, and other items needing protection. A third compartment is not watertight, and can be used for drinks and other similar items, and may include cup holders 40. As seen in FIG. 9, in some embodiments one or more slots 15 to hold mobile phones or other devices may be provided.

One or more umbrella or flag holders 48 may be provided, so that the umbrellas may be inserted to provide shade for users, or one or more diver's flags can be inserted to provide notice that divers are in the area. A GPS device 18*a* may be located in the floating device or lid. LED or other forms of lights 72 may be provided, such as an LED or light strip 70 along the outside circumference of the float. Lights may include emergency or flashing lights as well for use in case of emergency situations or to draw attention to the float.

Figure 6:
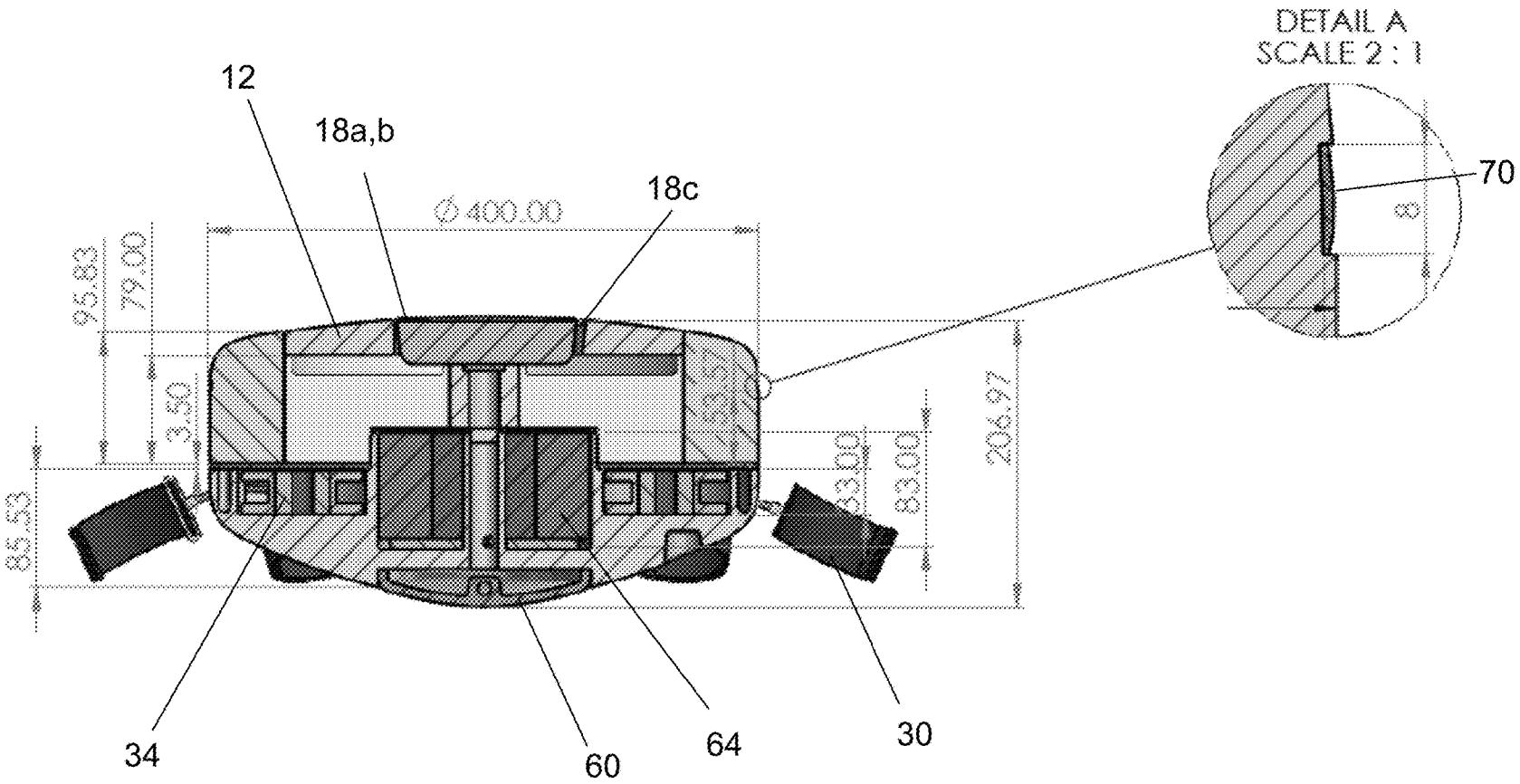
FIG. 6 shows a cross-sectional view of the central float of FIG. 3.

In additional embodiments, holders for an MP3 player or music-playing device may be provided in or on the central floating device. An MP3 player or music-playing device with speakers also may be built-into the floating device, or in the lid 12 or a central part of the lid 12*a*, which may be independently removable Similarly, a Bluetooth communications device 18*a* and/or wireless network device 18*b* could be securely installed in the central floating device in a protected space or in the central part 12*a* of the lid 12 with one or more water-resistant or water-proof speakers, either built-in 19*a* or independent 19. FIGS. 5 and 6 show the communications devices 18*a,b* as a removable part of the lid, and may be enclosed, waterproof, and independently floatable (i.e., it does not sink). A slot or hole 18*c* may be provided in the lid to assist in removing the communications device and/or speaker from the lid. A Bluetooth device (e.g., smartphone) on a beach or a lounge chair by a pool could be paired therewith, allowing music or other electronic transmission from the central floating device while the smartphone or other Bluetooth device can avoid water damage.

In some exemplary embodiments, extra-long tethers or/or anchors 68 may be provided to allow the central floating device to be secured to a point on or near the water, such as a pool ladder or a tree, thereby keeping the central floating device in a particular area.

Figure 4:
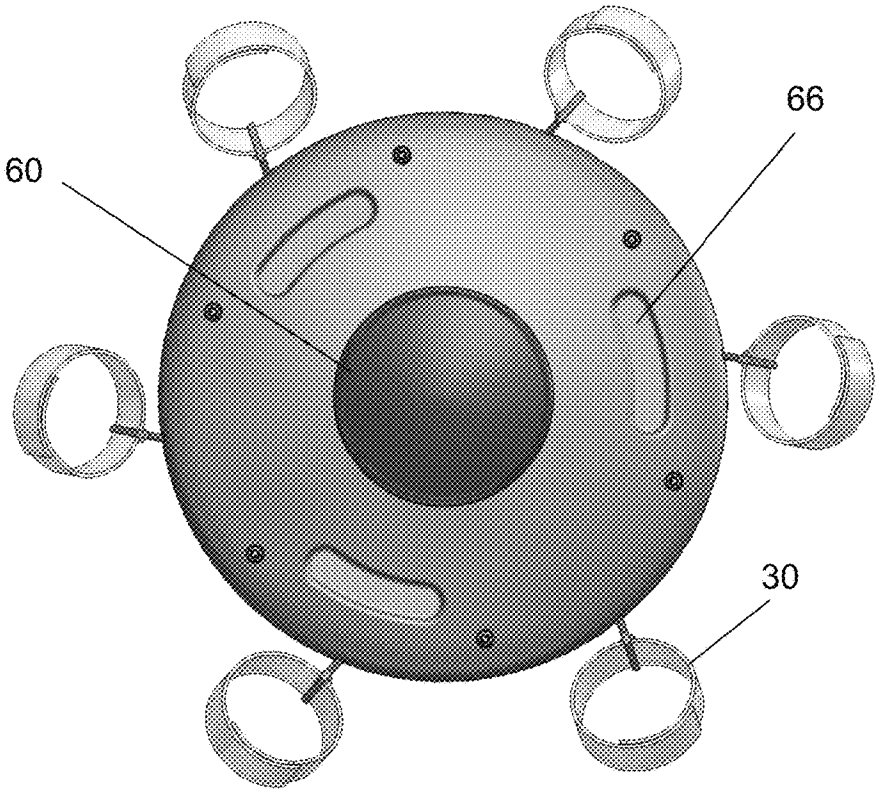
FIG. 4 shows a bottom view of a central float.

Similarly, in several exemplary embodiments, one or more anchors 60 attached by anchor lines or cables 62 may descend from the central floating device, thereby also keeping the central floating device in a particular area. The anchor line could be attached to a motor or hand-crank for lowering and raising, have a wound spring with a ratchet, or other form of reel 64, so that the spring or reel winds as the anchor is lowered, and the pulls the anchor quickly to the float when released. The retracted anchor may fit within a cavity in the bottom of float, as seen in FIG. 4. In the event the group desires to travel further into or around a body of water, the anchor or anchor would be raised, the central floating device floated or drifted to a new location, and then released again to maintain the new location.

The anchor 60 may be interchangeable, so that different configurations, shapes, sizes, and weights of anchors could be used for different bodies of water with different types of bottoms (e.g., flat cement pool bottom, rocky/sandy lake bottom, and so on). The anchor (and line) could be completely removed from the central floating device, allowing free movement thereof. Indentations or recessed handles 66 may be provided in the bottom or other parts of the main body of the float to help in users holding, pulling, or or carrying the float.

FIG. 9 shows an alternative configuration, with additional details. The bottom unit of the float housing is connected to the top or upper unit of the float housing via a plurality of connection screws 92 inserted through mounting bosses 94 and through holes in a flat separating section into threaded insert locking nuts 96 in a bottom surface 86 of the upper unit. Much of the material between the reel housings has been removed from bottom unit to leave hollow gaps or voids 88 to help lighten the float and provide buoyancy.

Figure 8:
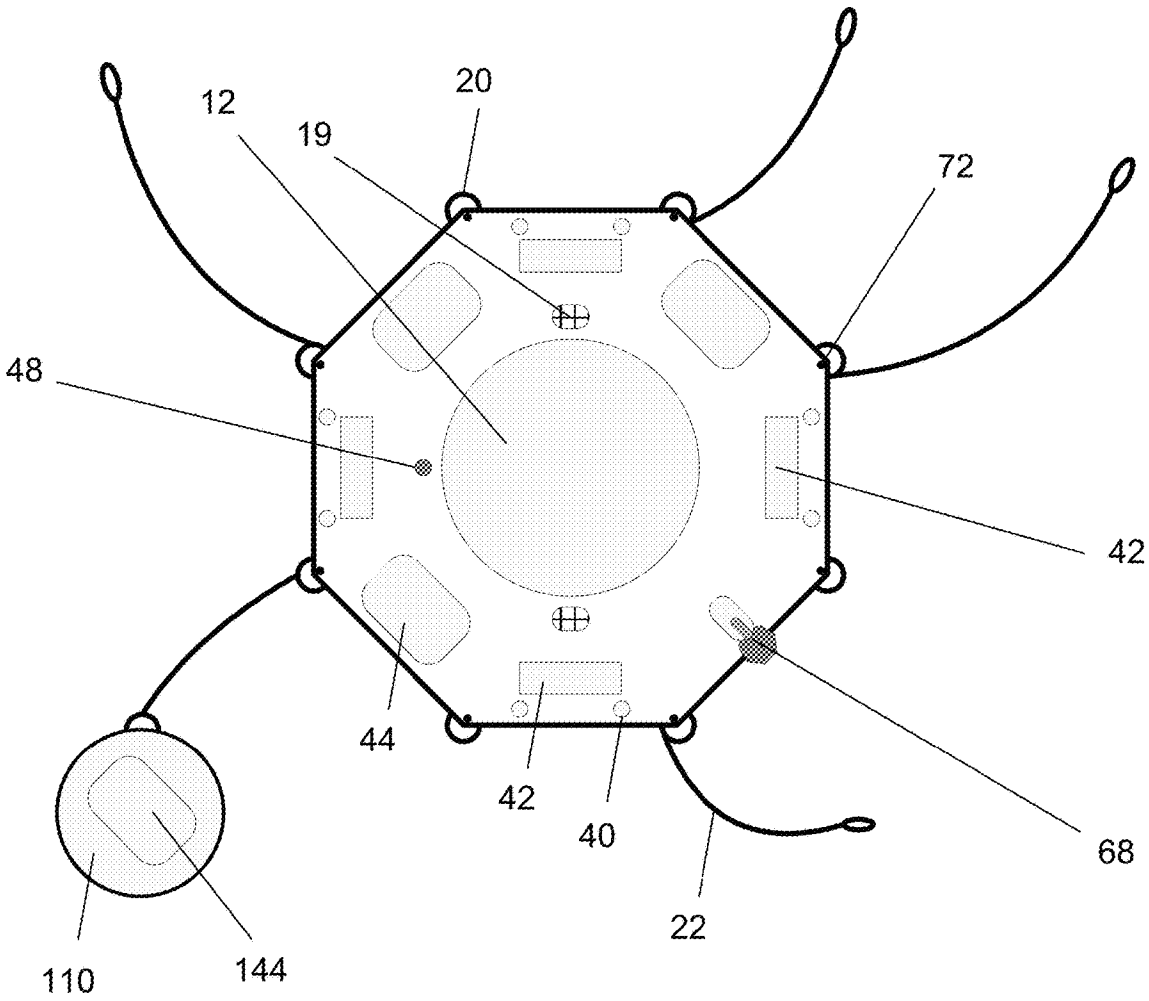
FIG. 8 shows a top view of a octagonal central float with ancillary floating device.

In yet a further embodiment, as seen in FIG. 8, a second or ancillary floating device 110 can be attached to the central floating unit. The second device can be another central floating device, thereby allowing multiple central floating devices to be connected, with tether connections at multiple points on the central floating devices. Ancillary devices may be smaller, comprise additional support features (e.g., cup holders, coolers, storage areas 144), and/or have no user tether connections (other than the tether connection to a central floating device).

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A water floating device, comprising:

a central float with a polygonal main body with a circumference, with a plurality of connection points positioned around the circumference;

at least four tether cords with a float end and a user end, wherein the float end of each tether cord is attached to a retractable reel at one of the plurality of connection points on the central float; and at least four straps, each strap removably fastened to the user end of each corresponding tether cord;

wherein the polygon is a circle, oval, square, hexagon, or octagon;

wherein the main body comprises at least one compartment;

wherein the central float is configured to connect a plurality of users floating in water adjacent to the central float.

2. The device of claim 1, wherein the float end of each tether cord is magnetically fastened to the corresponding connection point.

3. The device of claim 1, further comprising one or more storage areas in the central float.

4. The device of claim 3, wherein said one or more storage areas are water-tight.

5. The device of claim 1, further comprising an anchor configured to descend from the central float.

6. The device of claim 1, further comprising a plurality of lights on the central float.

7. The device of claim 1, further comprising a light strip extending around an outer circumference of the central float.

8. The device of claim 1, wherein each strap is an ankle strap.

9. The device of claim 8, wherein each ankle strap comprises a hook-and-loop fastener.

10. The device of claim 1, further comprising one or more cup-holders in the central float.

11. The device of claim 1, further comprising a GPS device in the central float.

12. The device of claim 1, further comprising a Bluetooth or wireless communication device in the central float.

13. The device of claim 1, further comprising one or more speakers in the central float.

14. A water floating device, comprising:

a circular central float with a plurality of connection points;

a plurality of tether cords with a float end and a user end, wherein the float end of each tether cord is removably fastened to connection points on the central float; and a plurality of straps, each strap removably fastened to the user end of each corresponding tether cord;

wherein the central float is configured to connect a plurality of users in water adjacent to the central float.

15. The device of claim 14, further comprising a central storage area in the central float.

16. The device of claim 15, further comprising a circular lid covering the central storage area, wherein the circular lid comprises a center of a top side of the central float.

* * * * *